US005522163A

United States Patent [19]

Neugebauer

[11] Patent Number: 5,522,163

[45] Date of Patent: Jun. 4, 1996

[54] CARD HOLDER

[75] Inventor: Edward J. Neugebauer, Westlake, Ohio

[73] Assignee: Pro-Mold and Tool Company, Elyria, Ohio

[21] Appl. No.: 272,237

[22] Filed: Jul. 8, 1994

[51] Int. Cl.[6] ..... G09F 1/12

[52] U.S. Cl. ..... 40/780; 40/661; 40/790; 206/449

[58] Field of Search ..... 40/661, 159.2, 40/156; 206/449, 455, 456, 45.34, 39, 452

[56] References Cited

U.S. PATENT DOCUMENTS

| | | | |
|---|---|---|---|
| 4,322,001 | 3/1982 | Hurley | 206/449 |
| 4,431,114 | 2/1984 | Kleinfeld | 206/45.34 X |
| 4,736,840 | 4/1988 | Deiglmeier | 206/313 |
| 4,829,691 | 5/1989 | Manjos et al. | 40/661 |
| 4,979,619 | 12/1990 | Hager | 206/509 |
| 5,010,673 | 4/1991 | Connor et al. | 40/661 |
| 5,040,671 | 8/1991 | Hager | 206/39 |
| 5,046,616 | 9/1991 | Makowski et al. | 206/467 |
| 5,056,251 | 10/1991 | Connor et al. | 40/661 |
| 5,087,145 | 2/1992 | Cooley | 206/456 X |
| 5,097,953 | 3/1992 | Gingras | 206/454 |
| 5,119,574 | 6/1992 | King | 40/537 |
| 5,121,563 | 6/1992 | Connor et al. | 40/661 |
| 5,125,505 | 6/1992 | Kurosaki | 206/449 X |
| 5,133,450 | 7/1992 | Rademacher | 206/44 B |
| 5,148,618 | 9/1992 | Brewster | 40/661 X |
| 5,224,600 | 7/1993 | Neugebauer | 206/449 |

*Primary Examiner*—Peter M. Cuomo
*Assistant Examiner*—James O. Hansen
*Attorney, Agent, or Firm*—Thompson Hine & Flory

[57] ABSTRACT

A cardholder for displaying a card including a transparent base with a wall having a slot therein, a transparent cover having a flange extending therefrom, and a threaded fastener wherein the flange on the cover engages the slot in the wall and the threaded fastener engages apertures in both the base and cover to secure the card holder in a closed position.

10 Claims, 1 Drawing Sheet

CARD HOLDER

BACKGROUND OF THE INVENTION

The present invention relates generally to devices for holding cards and more particularly pertains to a card holder suitable for the protection and presentation of sports cards, photographs and the like.

The collection, buying, selling and trading of sports cards has created a need for a means to easily and inexpensively display, protect and store such cards. To suit this demand, numerous card holders have been designed. For example, U.S. Pat. No. 5,224,600 to Neugebauer describes a card holder in which a transparent cover frictionally engages a transparent base to hold the card. Other card holders have been designed in which the base and cover are joined together by means of a plurality of screws. Usually these holders, known as screw down holders, consist of a top plate and a bottom plate which are held together by four screws, one in each corner of the holder.

Because these four screw card holders do have four screws, they are tedious to open and close. Before the card holder can be opened, each screw must be removed. Once opened, the user must keep track of four screws. To insure proper closure of these card holders, each screw must be reinserted in the holder. Thus, opening and closing this style of card holders is tedious and time consuming.

The designs of known screw down card holders also have the disadvantage of being too large to file with unprotected cards in standard set monster boxes. Monster boxes are enlarged standard storage boxes which hold 3,200–5,000 cards. Instead of the long side of the card being laid on the bottom of the box as in standard set storage boxes, the shorter side of the card is on the bottom of the box so that the cards stand upright. Unfortunately, these monster boxes are not able to accommodate the standard four screw card holder model because of the size of the holder. As one can imagine, to accommodate four separate screws, the card holder will at least be longer than the size of the card by the diameter of the head of the screws which are used to secure the holder. The advantage of storing cards in a storage box is that the box prevents light rays from damaging the cards. As one would expect, faded cards are worth substantially less than those in mint condition. Thus, a need has developed for a screw down card holder having dimensions smaller than those of conventional screw down card holders.

SUMMARY OF THE INVENTION

The card holder of the present invention comprises a transparent base and cover. The base and cover are joined together by means of a single threaded fastener, preferably a screw. The base includes a wall at one end having at least one slot therein which slidably receives at least one corresponding flange on the cover. The cover is slidably engaged with the base and the two pieces are secured by the threaded fastener which engages an aperture in both plates. Further, the base includes a collar which surrounds the threaded fastener receiving aperture. This collar engages a corresponding counter bore on the inside of the cover to temporarily secure the card holder in a closed position even when the threaded fastener has not been inserted aperture.

The card holder of this invention provides the same benefits as a conventional four screw holder without any of the problems common to that type of card holder. Rather than having four screws, this card holder is closed by one threaded fastener, thus reducing the number of fasteners the user must keep track of and reducing the amount of time and effort required to open and close the card holder.

Many collectors desire to keep their cards in a particular order in which more valuable cards are stored with cards of lesser value. The card holder of the present invention has an advantage of being only slightly larger than a standard card and, therefore, conveniently fits in most card set monster boxes with cards that are unprotected. The flat, smooth sides of the card holder prevent damage to adjacent unprotected cards with which the card holder is stored.

The card holder also permits the display of both sides of the card, protects the card during normal handling and storage, provides a base and cover that are secured by means of a screw, and are easily separated. Further, the thickness of the transparent plate gives the appearance of depth when viewing the card.

DETAILED DESCRIPTION

Figure 1:
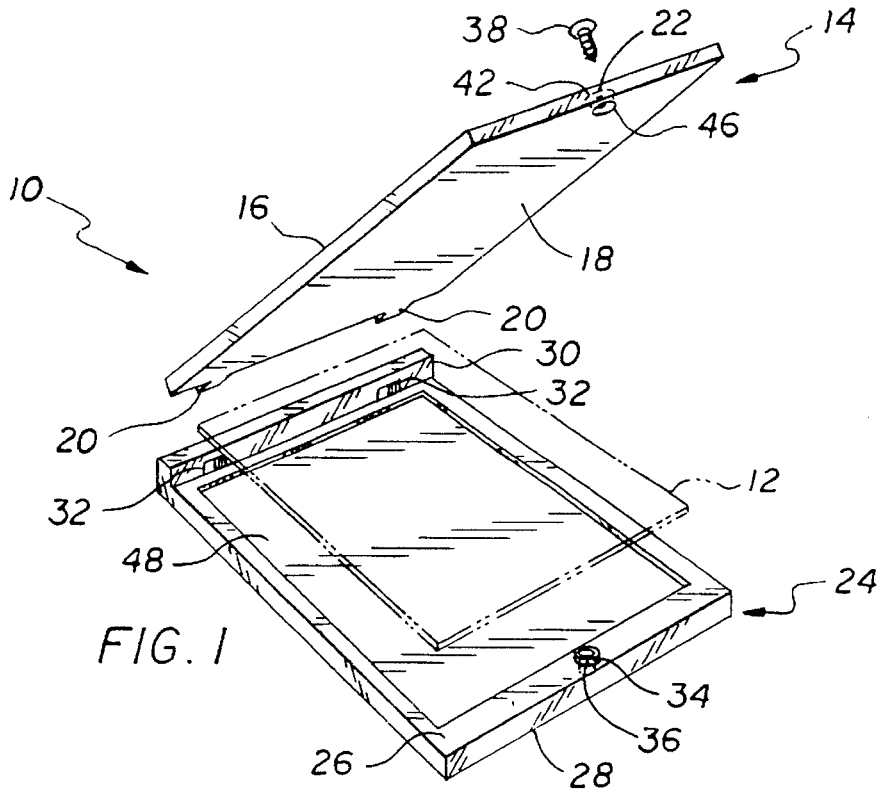
FIG. 1 is a perspective view of the card holder of this invention in a disassembled state.
Figure 2:
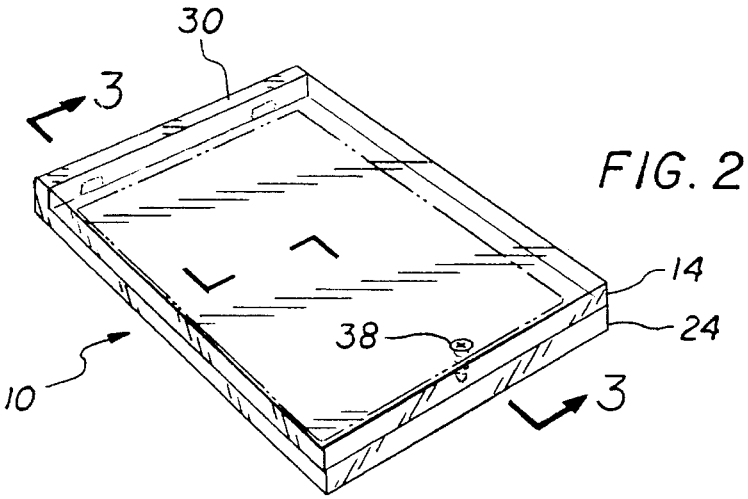
FIG. 2 is a perspective view of the card holder of this invention in an assembled state.
Figure 3:
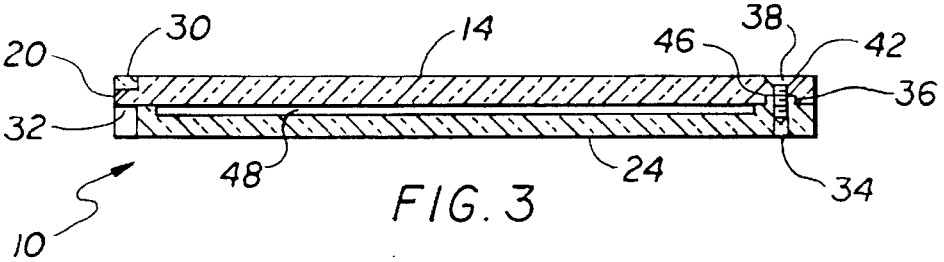
FIG. 3 is a cross sectional view of the card holder of this invention taken along line 3—3 of FIG. 2.

Referring to FIGS. 1–3, a card holder 10 of the present invention comprises a cover 14 having a top surface 16 and a bottom surface 18; a base 24 having a top surface 26 and a bottom surface 28; and a threaded fastener 38.

Referring to FIGS. 1–3, the base 24 is rectangular in shape and made from a clear rigid material such as plastic, preferably, base 24 is injection-molded from crystalline polystyrene. Base 24 has a smooth, flat bottom surface 28 and a top surface 26 having a recess 48 therein. The recess 48 has the approximate dimensions of a standard sports card 12. The depth of recess 12 is approximately equal to the thickness of a standard sports card 12. The bottom plate 24 has, at one end, a wall 30 and, at the end opposite the wall 30, an aperture 34 for receiving the threaded fastener 38. The wall 30 extends perpendicularly from the top surface 26 of base 24 and has at least one slot 32 therein. Slot 32 extends perpendicularly through wall 30 and parallel to top surface 26 of base 24. Wall 30 extends above the top surface 26 of base 24, a distance equal to the height of cover 14. Aperture 34 is surrounded on the top surface 26 by a collar 36.

The cover 14 is also rectangular in shape and is preferably made from the same clear rigid material as the base 24. Cover 14 is also preferably made from crystalline polystyrene. The cover 14 has a length which is shorter than the length of the base 24 by the width of wall 30. As stated previously, cover 14 has a height equal to the distance wall 30 extends above the top surface 26 of base 24. At one end, cover 14 has at least one flange 20 which corresponds to and slidably engages slot 32 in wall 30 on base 24. Although described herein as having at least one flange 20 and at least one slot 32, the card holder 10 of the present invention preferably includes two flanges 20 and two corresponding slots 34. Flange 20 extends from cover 14 parallel to top surface 16 and bottom surface 18. At the opposite end, the cover 14 includes an aperture 22 which receives threaded fastener 38. Aperture 22 includes a recess 42, which receives the beveled edge 40 of threaded fastener 38, on the top surface 16 of cover 14. Aperture 22 also includes a counter bore 46, which engages collar 36, on the bottom surface 18 of cover 14.

As shown in FIGS. 1 and 2, the card holder 10 for holding the card 12 is assembled by inserting flange 20 into slot 32 in wall 30. Cover 14 and base 24 are brought together so that collar 36 engages counter bore 46. The engagement of collar 36 and counter bore 46 acts to seat flange 20 into aperture 34. Preferably, collar 36 and counter bore 46 have a friction fit which temporarily maintains card holder 10 in a closed position before threaded fastener 38 is inserted.

As shown in FIG. 2, once cover 14 and base 24 have been brought together, threaded fastener 38 is then inserted into recess 42 of aperture 22 to secure the holder 10 in a closed position. Threaded fastener 38 is then turned so that it engages aperture 34 in base 24. Aperture 34 in base 24 does not necessarily have to be threaded. Provided that the diameter of aperture 34 is slightly less than the diameter of the threads of threaded fastener 38 and because of the soft nature of crystalline polystyrene, threaded fastener 38 will create the threads in aperture 34 to secure itself in position. Once threaded fastener 38 has been fully inserted to close the card holder 10, the head of threaded fastener 38 is flush with top surface 16 of cover 14, as shown in FIG. 3. In this flush position, threaded fastener 38 is prevented from scratching or tearing adjacent cards not contained in holders. Threaded fastener 38 can be any type of threaded fastener such as a screw or a bolt with a screw being preferred.

The design of the card holder 10 is possible because baseball cards, other sports cards, photographs, etc. are most often made to a standard shape and size. For example, a standard baseball card measures approximately 2.5 inches in width and 3.5 inches in length. Consequently, cover 14 and base 24 have an area slightly larger than a predetermined area of the face of the card 12. The assembled card holder 10 has a length less than 0.6 inch longer than a standard card 12 and a width less than 0.4 inch wider than a standard card 12. To provide for dimensional variations among different cards, the recess 48 in base 24 may be up to 0.030 inches greater than the predetermined length and width of the card.

The exterior corners of cover 14 and base 24 may be rounded to further prevent the holder 10 from damaging adjacent, unprotected cards. It has been found that a radius of 0.03 inch to 0.06 inch provides the desired roundness.

The present invention is preferably designed for the display of a baseball card 12 and an advantage of the invention is that the number of fasteners required to close the card holder 10 is reduced. Thus, the card holder 10 of the invention can more easily and quickly be opened than standard four screw card holders.

Having described the invention in detail and by reference to preferred embodiments thereof, it will be apparent that modifications and variations are possible without departing from the scope of the invention defined in the appended claims.

What is claimed is:

1. A card holder for displaying a card, the card holder comprising:

a threaded fastener;

a transparent base having a top surface, a bottom surface, a first end and a second end opposite the first end, the first end having a first aperture therein for receiving the threaded fastener, the second end having a wall extending perpendicularly from the top surface, the wall having two slots therein, the base further including a raised collar which surrounds the first aperture and a recessed portion in its top surface having dimensions capable of receiving a collectible sports card and having no more than 0.030 inch greater than the dimensions of said collectible sports card; and a transparent cover having a top surface, a bottom surface, a first end, and a second end opposite the first end, the bottom surface having two flanges extending therefrom at the second end, the cover having a second aperture therein at the first end, the top surface having a recess at the first end, which surrounds the aperture, and the bottom surface having a counter bore surrounding the second aperture;

wherein, to secure the card holder in a closed position, the flanges on the cover are received in the slots in the walls of the base, the first and second apertures are aligned, the raised collar frictionally engages the counter bore, and the threaded fastener is inserted in the aligned apertures.

2. A card holder for displaying a card, the card holder comprising:

a threaded fastener;

a transparent base having a top surface, a bottom surface, a first end and a second end opposite the first end, the first end having a first aperture therein for receiving the threaded fastener, the second end having a wall extending perpendicularly from the top surface, the wall having at least one slot therein, the top surface further including a raised collar which surrounds the first aperture; and a transparent cover having a top surface, a bottom surface, a first end and a second end opposite the first end, the bottom surface having at least one flange extending therefrom at the second end, the cover having a second aperture therein at the first end, the top surface having a recess, which surrounds the second aperture, at the first end, the cover further including a counter bore corresponding to the position of the raised collar;

wherein, to secure the card holder in a closed position, the flange on the cover is received in the slot in the wall of the base, the first and second apertures are aligned so that the collar is received in the counter bore, and the threaded fastener is inserted into the aligned apertures.

3. The card holder of claim 2 wherein the collar is received in the counter bore in a friction fit which temporarily holds the cover in engagement with the base when the threaded fastener is not received in the aligned apertures.

4. The card holder of claim 3 wherein the base includes a recessed portion, the recessed portion having dimensions capable of receiving a collectible sports card.

5. The card holder of claim 4 wherein the card holder includes two flanges which engage two corresponding slots in the wall of the base, the top cover and the base are made of a clear rigid material and the recessed portion has dimensions capable of receiving a collectible sports card and having no more than 0.030 inch greater than the dimensions of said collectible sports card.

6. The card holder of claim 5 wherein the cover and the base are made of crystalline polystyrene.

7. The card holder of claim 2 wherein the top cover and the base are each made of a clear rigid material.

8. The card holder of claim 7 wherein the cover and the base are made of crystalline polystyrene.

9. The card holder of claim 8 wherein the card holder has a length less than 4.1 inches and a width less than 2.9 inches.

10. The card holder of claim 2 wherein the card holder has a length less than 4.1 inches and a width less than 2.9 inches.

* * * * *